United States Patent [19]

van der Lely et al.

[11] 4,040,227

[45] Aug. 9, 1977

[54] METHODS OF MANUFACTURING BUILDING SECTIONS

[76] Inventors: Cornelis van der Lely, Bruschenrain 7, Zug; Hendricus Jacobus Cornelis Nieuwenhoven, Hirssattelweg, 6340 Baar, both of Switzerland

[21] Appl. No.: 601,402

[22] Filed: Aug. 4, 1975

Related U.S. Application Data

[63] Continuation of Ser. No. 403,316, Oct. 3, 1973, abandoned.

[30] Foreign Application Priority Data

Oct. 3, 1972 Netherlands ..... 7213328

[51] Int. Cl.[2] ..... E04B 1/35

[52] U.S. Cl. ..... 52/745; 52/79.1; 52/624; 52/747

[58] Field of Search ..... 52/593, 589, 585, 741, 52/745, 747, 79, 754, 755, 756, 624, 582, 594

[56] References Cited

U.S. PATENT DOCUMENTS

| | | | |
|---|---|---|---|
| 1,886,962 | 11/1932 | Roche | 52/79 |
| 2,078,011 | 4/1937 | Neher | 52/582 X |
| 2,142,305 | 1/1939 | Davis | 52/589 |
| 2,423,695 | 7/1947 | Falco | 52/755 X |
| 2,647,287 | 8/1953 | Jones | 52/754 X |
| 3,159,440 | 12/1964 | Courtwright | 52/756 X |
| 3,180,059 | 4/1965 | Persak, Jr. | 52/589 X |
| 3,339,327 | 9/1967 | Kempf | 52/589 X |
| 3,440,788 | 4/1969 | Merget | 52/594 X |
| 3,481,068 | 12/1969 | Paulson | 52/594 X |
| 3,511,000 | 5/1970 | Kewls | 52/594 X |
| 3,563,578 | 2/1971 | Meller | 52/754 X |
| 3,729,875 | 5/1973 | Felson | 52/79 |
| 3,775,928 | 12/1973 | Dawson et al. | 52/741 |
| 3,834,110 | 9/1974 | Vircelletto | 52/745 |

FOREIGN PATENT DOCUMENTS

| | | | |
|---|---|---|---|
| 211,995 | 8/1956 | Australia | 52/585 |
| 493,900 | 6/1953 | Canada | 52/754 |
| 1,138,956 | 1/1969 | United Kingdom | 52/79 |

*Primary Examiner*—Leslie Braun

*Attorney, Agent, or Firm*—Mason, Mason & Albright

[57] ABSTRACT

A method of manufacturing a box-shaped space-enclosing prefabricated building section having dimensions compatible with and sized for being transported on highways by transport vehicle.

5 Claims, 21 Drawing Figures

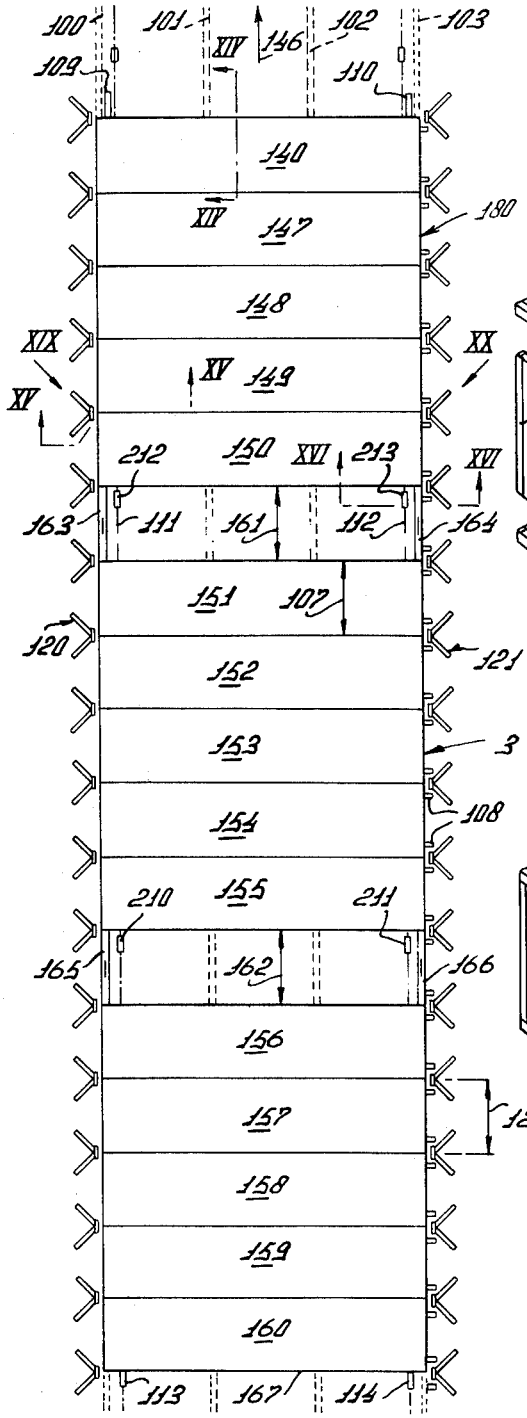
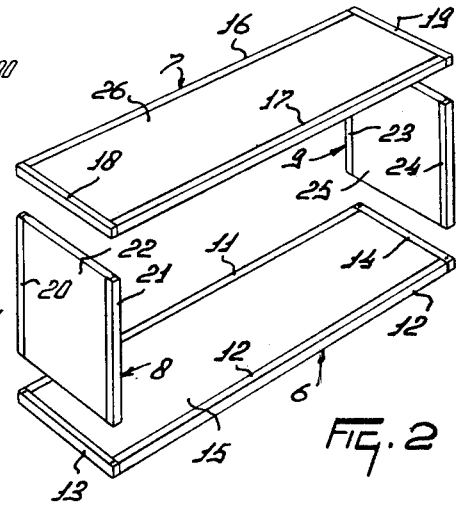
FIG. 2
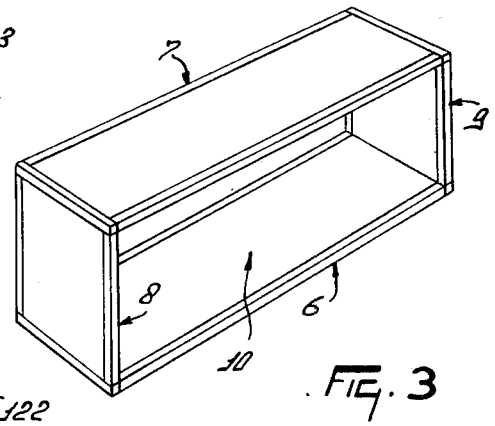
FIG. 3
FIG. 4

FIG. 5
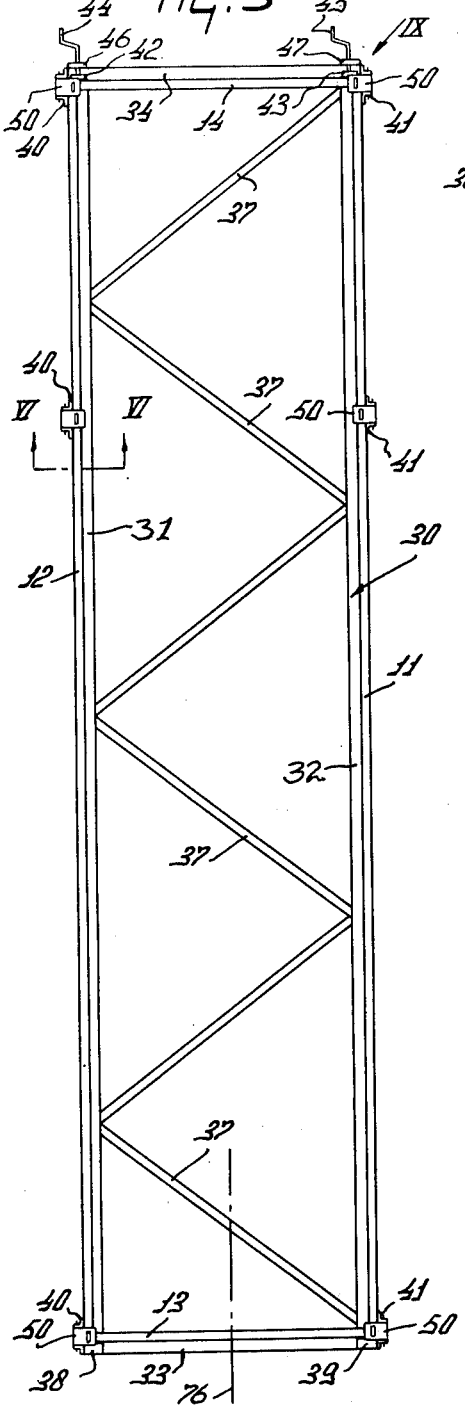
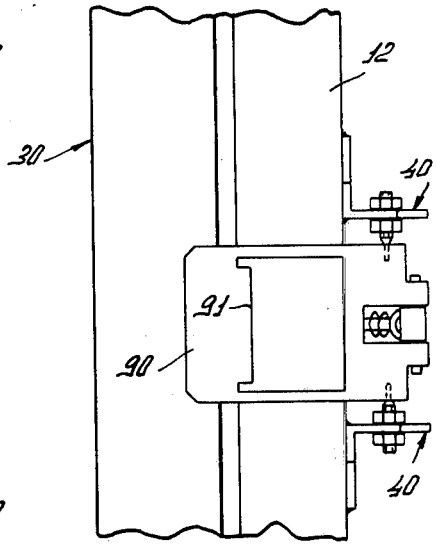
FIG. 10
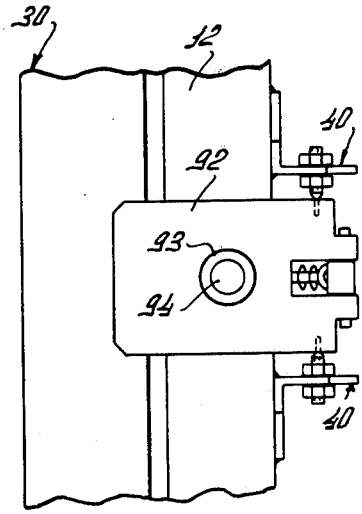
FIG. 11

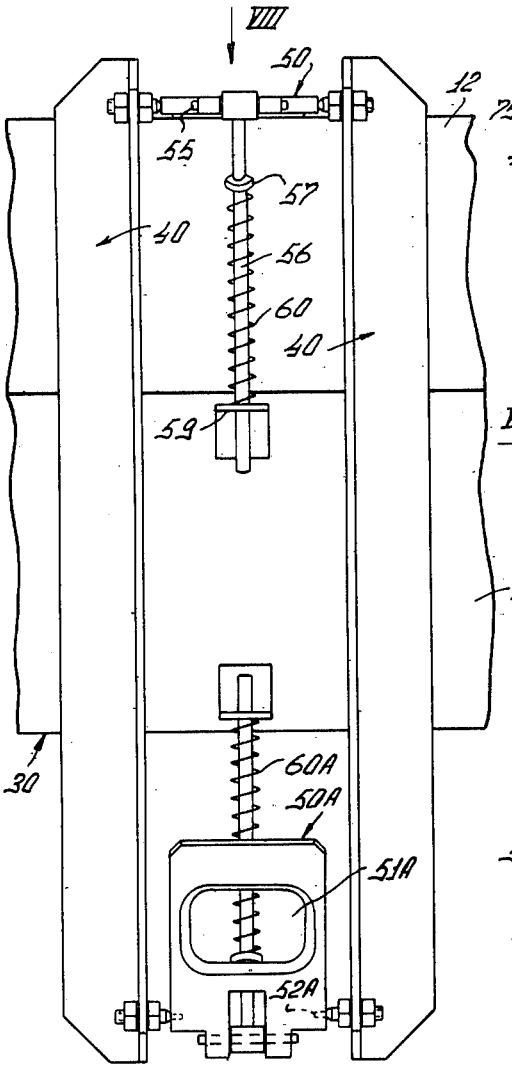
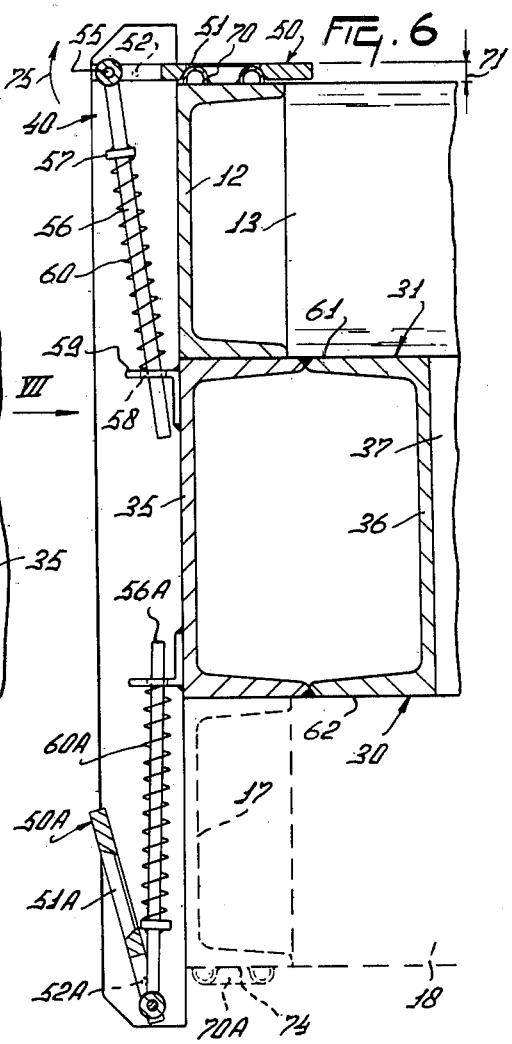
FIG. 7
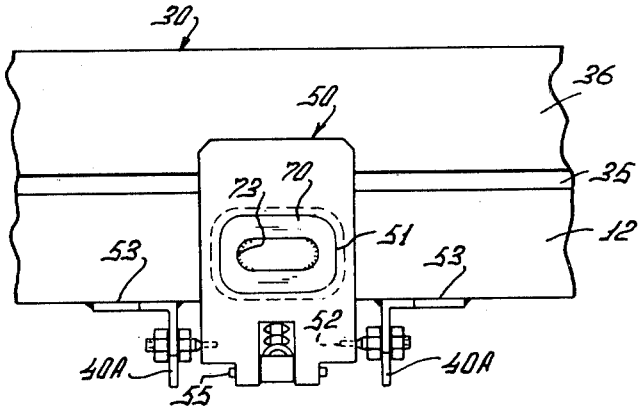
FIG. 8

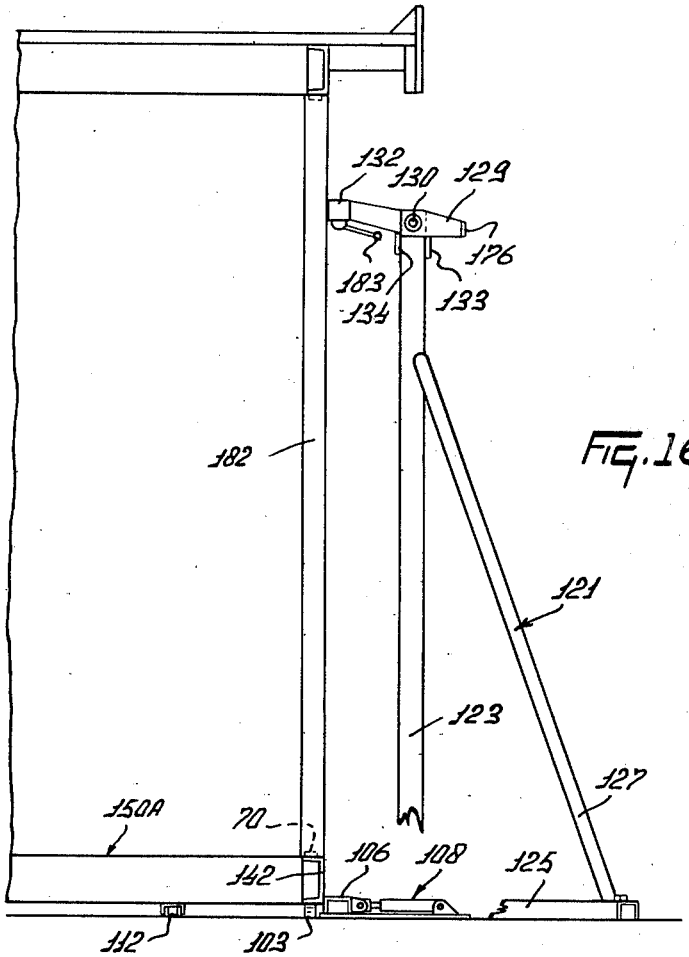
FIG. 16
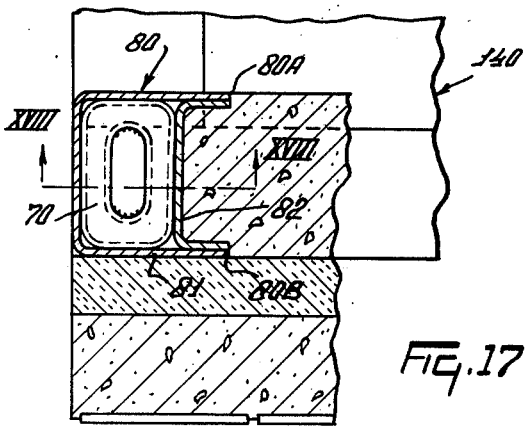
FIG. 17
FIG. 18
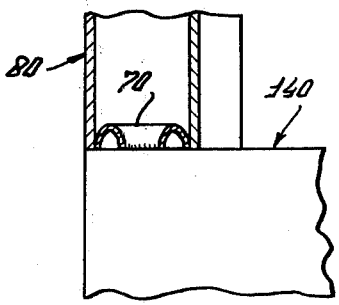

132
131
183
125
126
127
124
120
133
120A
130
146
128
134
129
176
174
105
150
70
172
171
170
149
181
106
108

METHODS OF MANUFACTURING BUILDING SECTIONS

This is a continuation of application Ser. No. 403,316, filed Oct. 3,1973, now abandoned.

This invention relates to methods of manufacturing space-enclosing sections of buildings.

One object of the invention is to provide a method by which the building section can be manufactured in a simple manner. According to one aspect of the invention, this can be achieved by a method of manufacturing a space-enclosing section of a building, wherein two or more panels are first made to form a floor and/or a wall and/or a top of the building section, these panels subsequently being fastened to each other to form the building section, and wherein at least one of said panels is provided during its manufacture with joining or connecting means for accurately positioning a second panel relative thereto during the assembly of the section by securing the panels to each other.

A joining or connecting means can thus be readily arranged on a panel and subsequently the panels can readily be arranged in their correct relative positions.

An advantageous form of the method embodying the invention is obtained by making the floor and/or the ceiling panels from frames of metal beams, to which frames the joining or connecting means are secured.

A satisfactory interconnection of the panels can by obtained by providing, in accordance with a further aspect of the invention, a wall panel with a metal beam having a counter-connecting means.

The provision of joining or connecting means on the panels can readily be carried out in a simple manner by arranging at least part of a panel in a jig having directive means which determines the positions of the joining or connecting means on the panels, in which jig the panels are equipped with the joining or connecting means.

The panels can readily be fastened to each other by arranging, in accordance with a further aspect of the invention, the wall panels on the floor panel at the joining or connecting means of the floor panel and by holding them in the correct position relative to the floor panel with the aid of at least one supporting member, after which the walls are secured to the floor panel.

The invention furthermore relates to a space-enclosing section of a building, said section comprising, in accordance with a further aspect of the invention, interconnected panels, at least one panel being provided with joining or connecting means on which a joined panel is arranged with accurate fit. In this way a satisfactory building section is easily obtained.

The invention furthermore relates to a jig for the manufacture of a panel, said jig being provided, in accordance with a further aspect of the invention, with a holder adapted to receive at least part of a panel, the jig comprising directive means for determining the position of the joining or connecting means on at least said part of the panel.

For a better understanding of the invention, and to show how the same may be carried into effect, reference will now be made, by way of example, to the accompanying drawings, in which:

FIG. 2 is a schematic perspective view of panels for a building section, FIG. 3 is a schematic perspective view of a building section, FIG. 4 is an enlarged plan view of a mounting section.

FIG. 5 is an elevation of a manufacturing jig for the skeleton of a panel,

Figure 9:
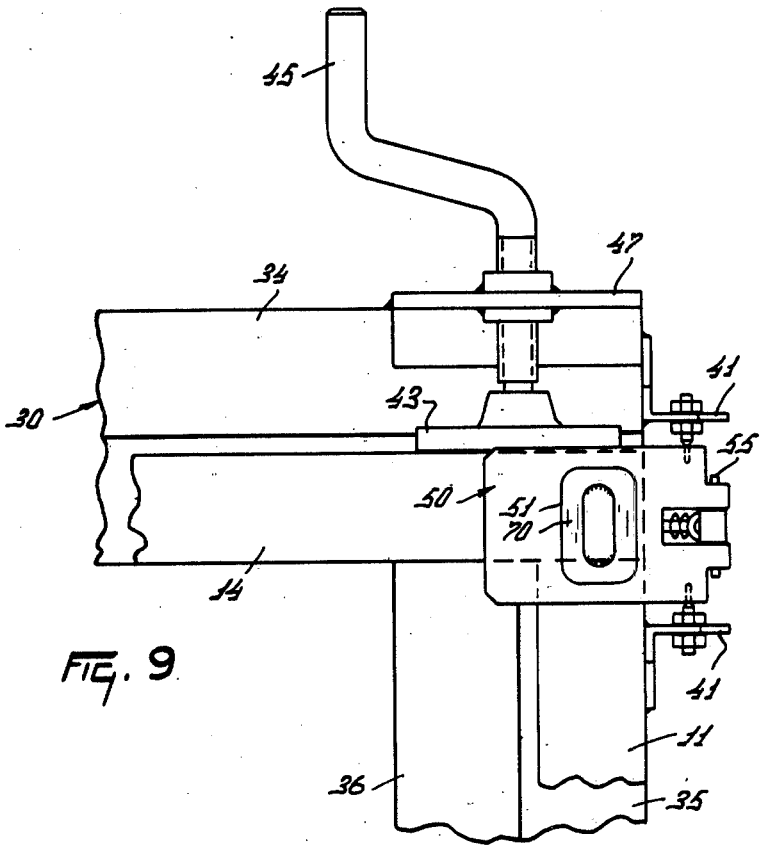
Figure 12:
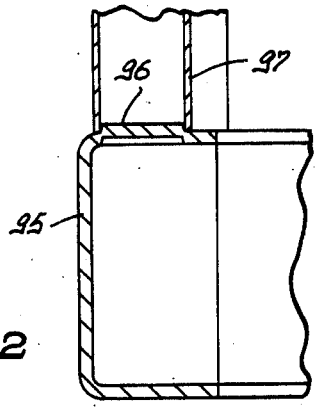
Figure 13:
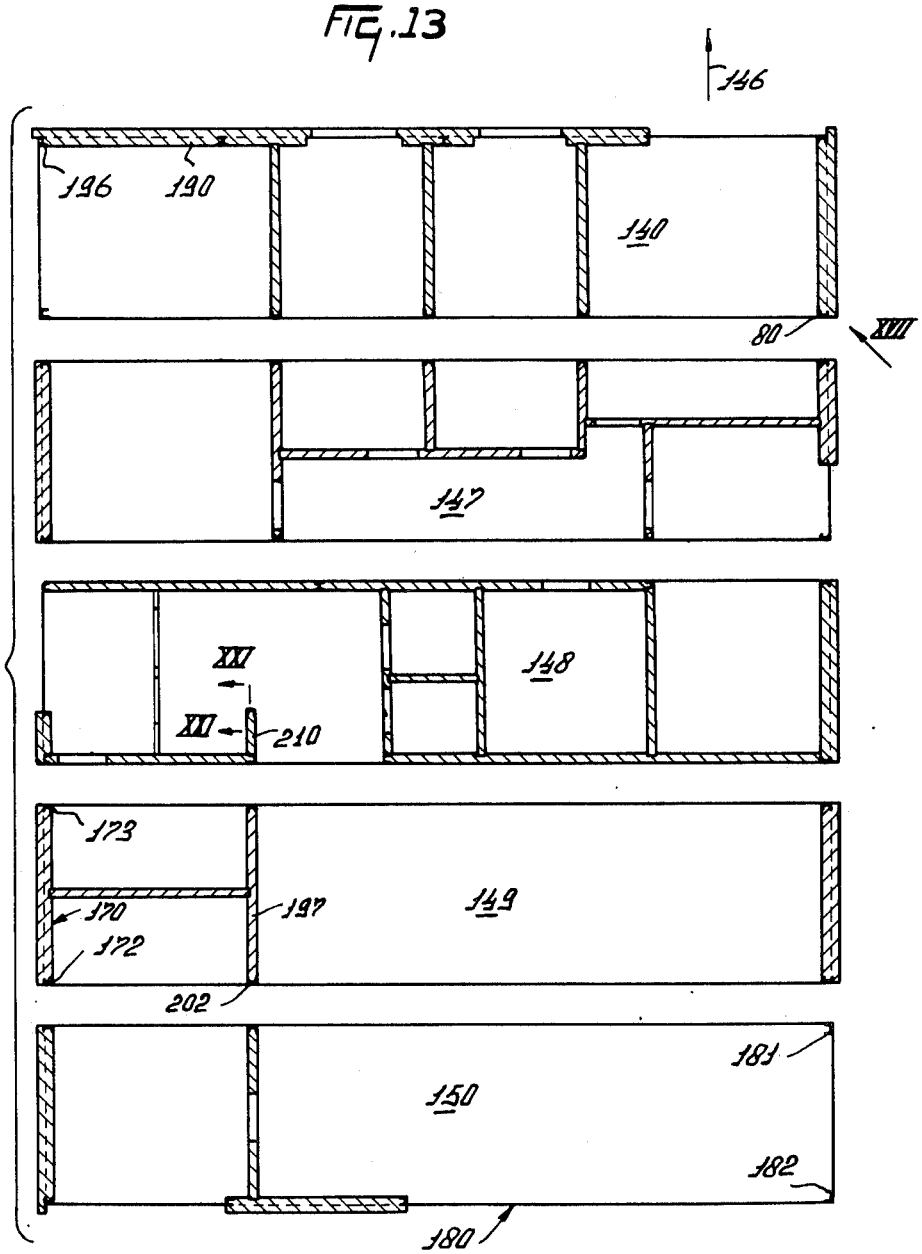
Figure 14:
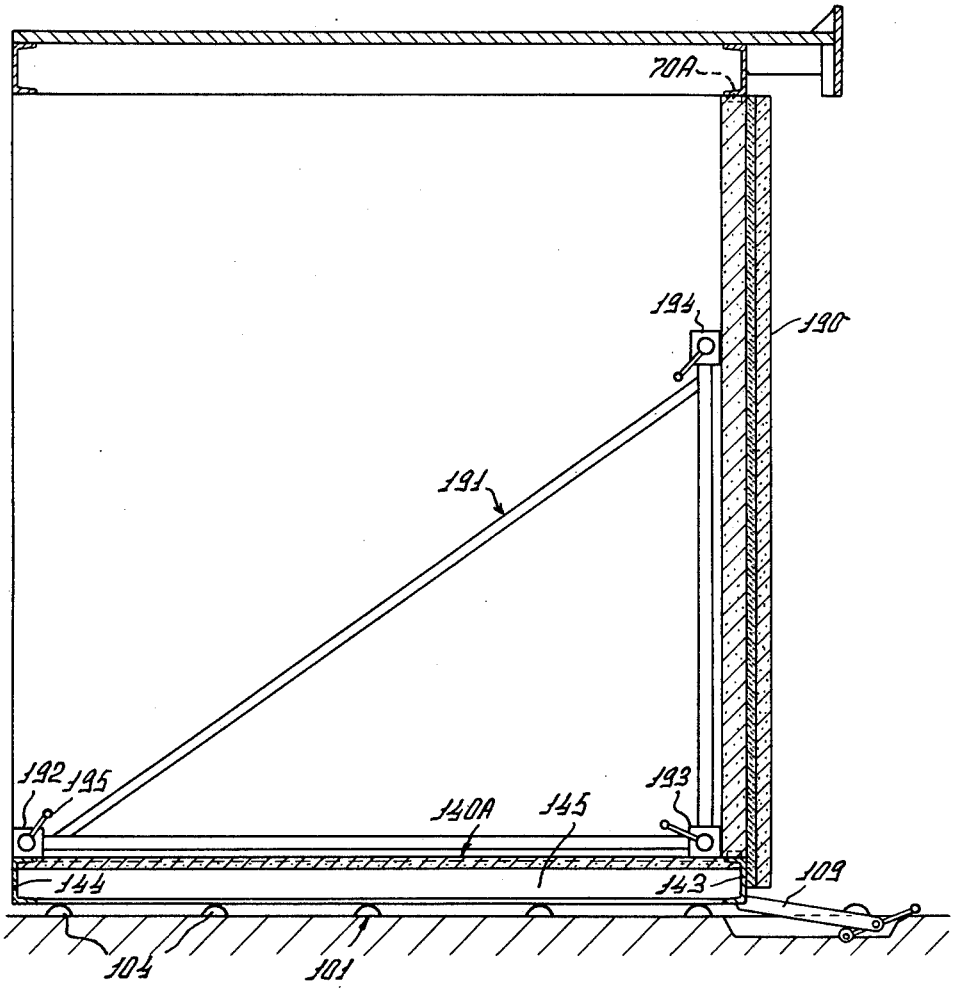
Figure 21:
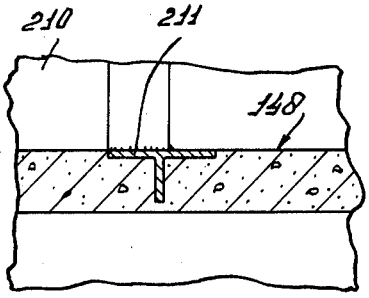
Figure 15:
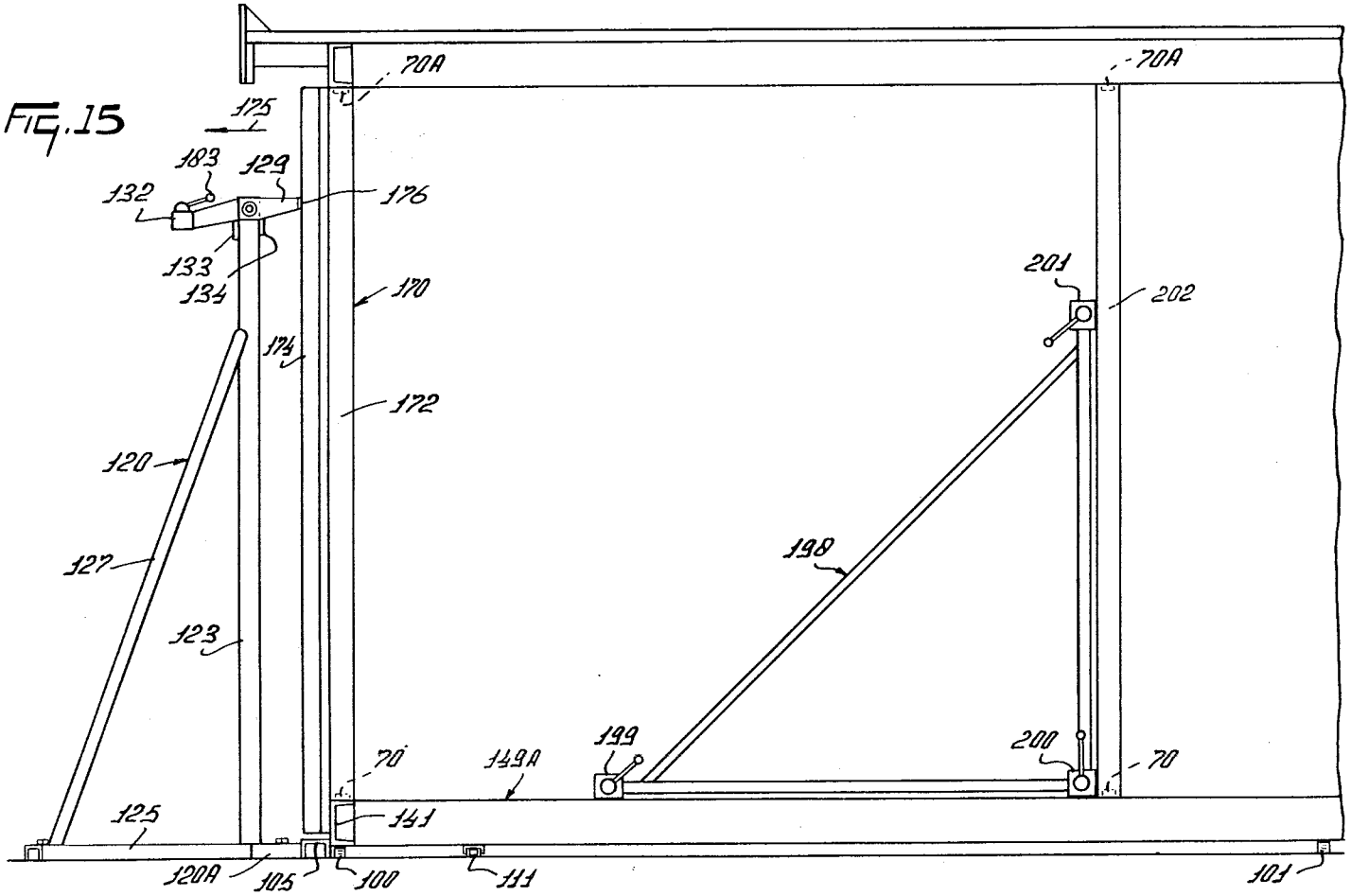
Figures 19, 20:
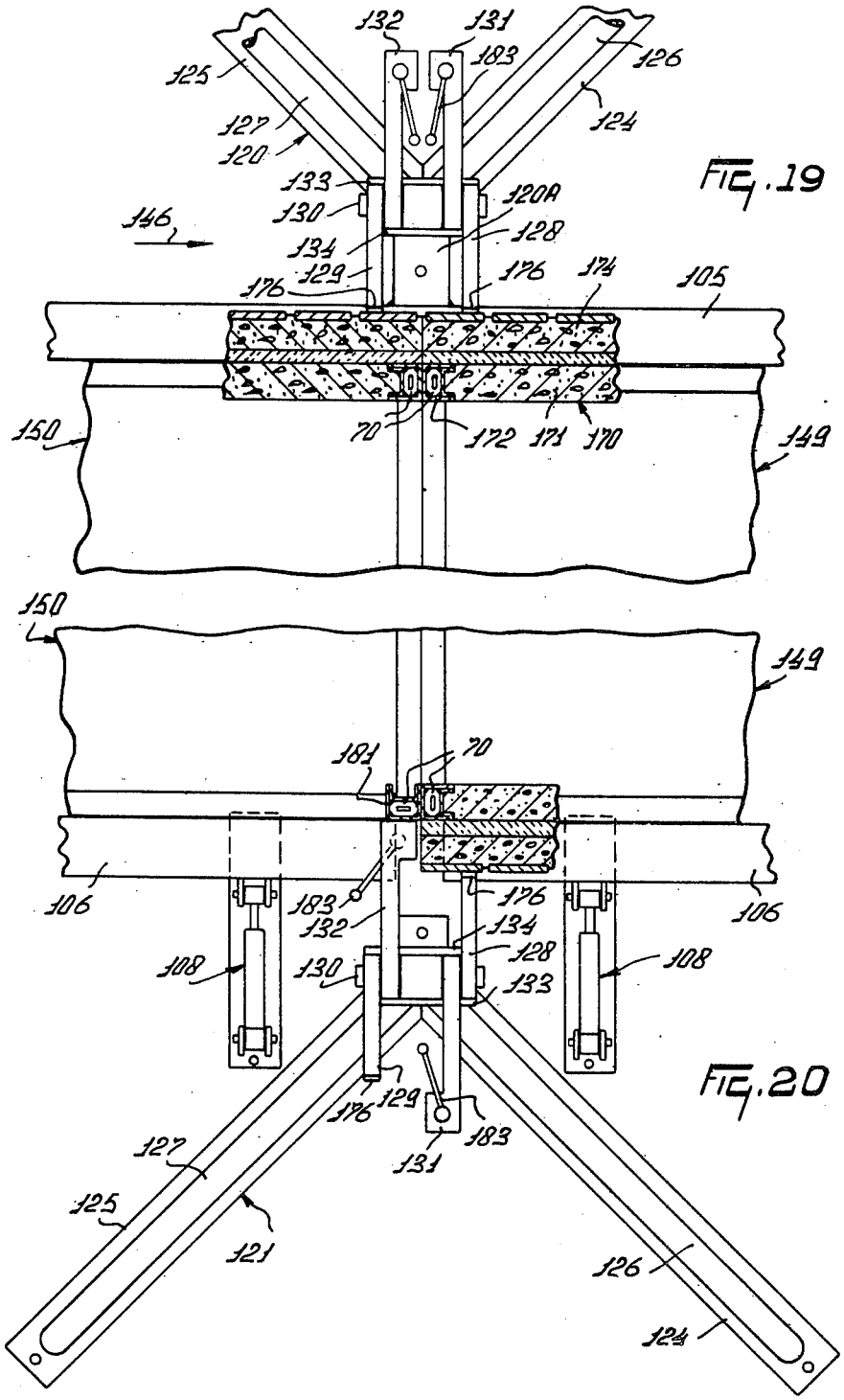

FIG. 6 is a sectional view of a portion of the jig, comprising a stop and directive means as shown in FIG. 5, taken on the line VI—VI in FIG. 5, FIG. 7 is an elevation of the panel portion of FIG. 6 viewed in the direction of the arrow VII in FIG. 6, FIG. 8 is an elevation of the directive means of FIG. 7 viewed in the direction of the arrow VIII in FIG. 7, FIG. 9 is an elevation of a corner portion of the jig of FIG. 5 indicated by the arrow IX, FIG. 10 is an elevation similar to that of FIG. 8 but of a different form of directive means, FIG. 11 is an elevation similar to FIG. 8 but of a further embodiment of directive means for cooperation with joining or connecting means, FIG. 12 is a vertical sectional view of a peripheral beam of a floor panel with a different embodiment of joining or connecting means, FIG. 13 is a plan of a building formed by a plurality of space-enclosing sections, FIG. 14 is a vertical sectional view of a building section in the mounting station taken on the line XIV—XIV in FIG. 4, FIG. 15 is a vertical sectional view of part of a building section taken on the line XV—XV in FIG. 4, FIG. 16 is a vertical sectional view of part of a building section and an elevation of a supporting member taken on the line XVI—XVI in FIG. 4, FIG. 17 is a horizontal sectional view of the connection of a wall panel with the corner of a floor panel, this corner corresponding with the corner indicated in FIG. 13 by the arrow XVII, FIG. 18 is a vertical sectional view of the junction corner of a wall on a floor panel taken on the line XVIII—XVIII in FIG. 17, FIG. 19 is a plan view of supporting members and of the joined edges of two walls indicated in FIG. 4 by the arrow XIX, FIG. 20 is a plan view of supporting members and joined edges of two adjacent sections, indicated in FIG. 4 by the arrow XX, and FIG. 21 is a vertical sectional view of part of a floor panel taken on the line XXI—XXI in FIG. 13, In accordance with the invention, building sections enclosing a space are composed of panels at a mounting station. The mounting station is preferably included in a production line, where the panels and the space-enclosing building sections are substantially completely finished.

Figure 1:
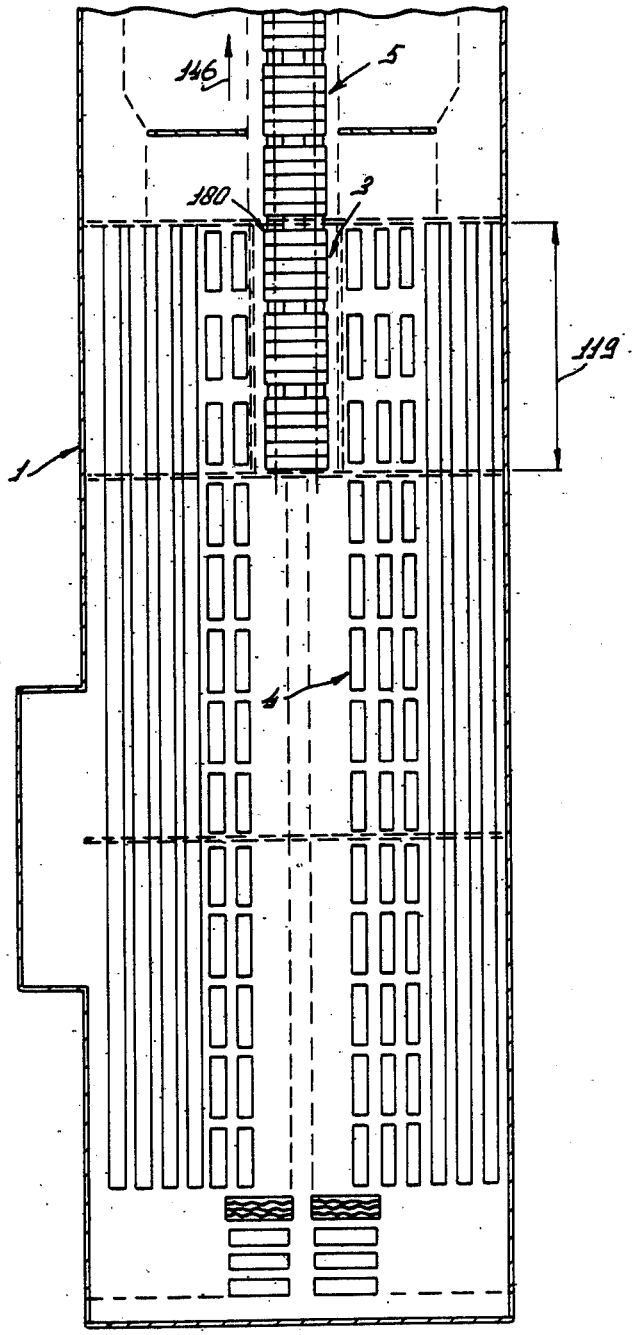
FIG. 1 illustrates a production line comprising a mounting station for the formation of building sections.

Referring to the drawings, FIG. 1 illustrates schematically a production line arranged in a factory hall 1. This production line includes a mounting station 3 where the space-enclosing building sections are formed from the panels. The production line comprises a manufacturing line 4 where the panels are made. The production line furthermore comprises a mounting line 5 (not shown in detail) where the building sections formed at the mounting station are completely finished, for example, by providing them with pipework, sanitary ware, kitchen equipment and ornamental layers on the wall and/or floors.

A building section principally comprises four panel 6, 7, 8 and 9 of the kind shown in FIG. 2. A space-bounding section, for example, the section 10 of FIG. 3 is formed by interconnecting the panels. The building section has the shape of a parallelepiped, the floor panel 6 and the ceiling panel 7 being rectangular panels having long sides or edges and short sides or edges. The main shape of the section shown in FIGS. 2 and 3 constitutes, in principle, the supporting structure of the section. The supporting structure is formed principally by a parallelepiped-shaped skeleton of metal beams arranged along the edges of the building section. This skeleton if formed by beams arranged along the edges of the panels. It will be apparent from FIGS. 2 and 3 that the floor panel 6 has a rectangular frame of two long beams 11 and 12 and two short beams 13 and 14. Inside this frame of beams 11 to 14 a floor filling 15 is provided, which consists of concrete in this embodiment. The panel 7, forming the top side of the section, has a rectangular frame of two long frame beams 16 and 17 and two frame beams 18 and 19. Inside the skeleton formed by the beams 16 to 19 a filling 26 is provided, which consists on the lower side of the panel preferably of suitable material for the ceiling of the section 10. If the panel 7 has to form the top side of the building, part of which the section 10 is intended for, the filling inside the skeleton formed by the beams 16 to 19 comprises a roof portion. The wall portion 8 has two vertical beams 20 and 21, between which a concrete filling 22 is arranged. The wall panel 9 has two vertical beams 23 and 24, within which a concrete slab 25 is arranged as a filling.

In order to ensure a correct relative arrangement of the panels at the mounting station, one or more panels are provided during manufacture with connecting means. If desired, other panels are provided with counter-connecting means joining the connecting means so that the place of one panel relative to the other panel is determined by the connecting means.

In the embodiment shown in the Figures the top side of the floor panel and the bottom side of the ceiling panel are provided with connecting means which determine the place where the wall panels are joined to the floor panel and to the ceiling panel. The wall panels have counter-connecting means joining the connecting means of the floor panel and the ceiling panel. In this embodiment the connecting means and the counter-connecting means are provided on the metal beams arranged in the various panels. The connecting means of the floor panel and of the ceiling panel are arranged on the metal frames formed by the beams 11 to 14 and 16 to 19 respectively. These metal frames are first made in a jig, after which the frames are provided with the respective fillings 15 and 26 respectively. The frames and the application of the filling are made in the manufacturing line 4, which is not shown in detail.

The manufacturing line 4 comprises one or more jigs for making the rectangular frames. FIG. 5 shows a jig 30 in which frames can be formed, to which connecting means can be secured at the desired places. The jig 30 has two long sides 31 and 32 and two short sides 33 and 34. Each of the sides 31 to 34 consists of two channel-section profiled beams welded to each other as is shown in FIG. 6 for the channel-section beams 35 and 36, forming in common the long side 31 of the jig 30. The four sides 31 to 34 are interconnected by a plurality of struts 37, as is shown in FIG. 5. The short side 33 is provided on one side of the jig 30 with stops 38 and 39. Along the long sides 31 and 32 are arranged several stops 40 and 41. The side 34 is provided with clamping members 42 and 43 connected with screw spindles 44 and 45. The screw spindles 44 and 45 are journalled in supports 46 and 47 (FIG. 9). From FIG. 5 it will be apparent that the side 31 is provided with three pairs of stops 40, whereas the side 32 is provided with three pairs of stops 41. Between each pair of stops 40 (see FIGS. 6, 7 and 8 for the pair of stops 40A and 40B) directive means 50 are arranged. The directive means 50 is formed by a rectangular plate having an opening 51. The directive means is adapted to turn about a shaft 52 between two adjacent stops 40A and 40B. Each of the stops 40A and 40B is formed by an angle-section beam, one side of which joins the channel-section beam 35. The side 53 of the stops 40 joining the beam 35 forms the abuttment side receiving a beam of a frame to be made, for example, the beam 12 of FIGS. 6, 7 and 8. The directive means 50 is coupled through a pivotal shaft 55 with a rod 56 having a ring 57. The end of the rod 56 is passed through a hole 58 of a guide 59. Between the guide 59 and the ring 57 the rod 56 is surrounded by a compression spring 60.

As will be seen from FIGS. 6 and 7, the stops 40 and 41 extend on either side of the jig 30 and thus form arresters on both sides of the jig. The sides 33 and 34 opposite the sides shown in FIG. 5 are provided with stops corresponding with the stops 38 and 39 or with clamping members corresponding with the clampings members 42 and 43, which is not shown in detail in the drawing. The stops 40 and 41 on the side 62 (FIG. 6) of the frame 30 are provided with directive means corresponding with the directive mean 50. Fig. 6 shows a corresponding directive means designated by 50A. The construction and the connection of these directive means 50A are similar to those of the directive means 50 so that details for the directive means 50A are omitted. In the jig shown in FIG. 5 the frames for the floor and ceiling panels 6 and 7 can be made and provided with the desired connecting means. As is shown in FIG. 5, the beams 11, 12, 13 and 14 for the floor panel are arranged in the jig. These beams are cut to length prior to the arrangement in the jig 30. The beams 11 and 12 are put against the stops 41 and 40 respectively. The beam 13 is in contact with the stops 38 and 39, whereas the beam 14 is in contact with the clamping members 42 and 43. By tightening the screw spindles 44 and 45 the beams can be clamped tight in the jig 30 via the clamping members 42 and 43. Then the beams 11 to 14 can be welded to each other so that a framework for the floor panel is obtained. On the side of the framework forming the top side of the floor panel connecting means 70 are provided at the desired places. The correct places of the connecting means are determined by the directive means 50 being moved into the position shown in the upper part of FIG. 6. The opening 51 in the directive plate 50 is shaped in a form such that the directive means 70 is held at the correct place on the beams of the frame-work by the plate 50. The directive means 50 thus form also holding means for the connecting means 70. It will be seen from FIG. 8 that the connecting means 70 has a rectangular shape with rounded-off corners and it forms an extension projecting over a height 71 above the top side of the beam 12. FIGS. 6 and 8 show that the inner side of the extension is welded across the opening 51 of the directive plate 50 to the beam 12 by a welding seam 73. In the same manner connecting means are fastened near the other directive means 50 at the places indicated in FIG. 5 so that the part of the floor panel consisting of the beams 11 to 14 is provided at the desired areas with a connecting means. On the side 62 of the jig 30 the framework formed by the frame beams 16 to 19 for the ceiling panel 7 can be made and be provided with connecting means. In the same manner as described for the beams 11 to 14 the beams 16 to 19 are arranged between the stops on the side 62 of the jig 30 and secured to each other. The beam 17 can be arranged in the jig 30 as is indicated in FIG. 6 by broken lines. Since the wall panels extend between the floor panel and the ceiling panel, directive means can be provided opposite the directive means 70 on the top side of the floor panel 6 at the ceiling panel 7. For this purpose directive means 50A are arranged on the jig 30 opposite the directive means 50. FIG. 6 shows the directive means 50A in the inoperative position. By turning the directive means 50A about the pivotal shaft 52A, it can be moved into a position which corresponds with the position of the directive means 50 shown in FIG. 6. As is indicated for the directive means 50, the directive means 50A can thus arrange a connecting means at the lower side 74 of the framework of the ceiling panel 7. The compression spring 60 holds the directive means 50 in the position shown in FIG. 6, since by the force exerted by the compression spring 60 on the ring 57 the rod 56 tends to turn about the shaft 52 in a direction 75. When the directive means are turned into a position as shown in FIG. 6 for the directive means 50A said means is turned about the shaft 52 to an extent such that the rod 56 arrives at that side of the shaft 52, whilst the force of the spring 60A holds the stop member in the offposition as is shown in FIG. 6 for the directive means 50A. In this manner opposite sides of floor panels and ceiling panels for a building section can be provided in a jig 30 with connecting means at the correct areas, the wall panel to be arranged between the floor and ceiling panels joining said means in a satisfactory manner. Although this is not shown in the Figures, the jig 30 may be adapted to turn, for example, about its longitudinal axis 76 so that the frame-work for the ceiling panel can be made on the top side of the jig, which facilitates the manufacture thereof. If desired, the jig 30 may be arranged in a vertical position so that on either side of the jig frameworks with the connecting means to be secured thereto can be made in a vertical position. After the manufacture of the frameworks for the floor and ceiling panels they are worked further on the manufacturing line by applying the fillings, for example, the fillings 15 and 26. When the panels are thus completely prefabricated, they can be conveyed to the mounting station, where they are joined to wall panels for the formation of a space-bounding building section.

The wall panels, for example, the wall panels 8 and 9 are composed on the manufacturing line 4 from two opposite supporting beams, between which wall material is arranged. The vertical beams, for example, the beams 20, 21, 22, 23 and 24 are constructed in this embodiment as is indicated in FIG. 7 for a beam 80. The beam 80 consists of two channel-section beams 81 and 82; the channel-section beam 81 is located inside the channel-section beam 81. These channel-section beams form a hollow beam having limbs 80A and 80B facing the inner side of the wall panel. The connecting means, for example, the connecting means 70, have a shape such that the ends of the hollow beams 80 accurately fit around the circumference of the connecting means 70, as is shown in FIG. 17. The lower ends of the beams 20 and 21 of a wall panel, corresponding with the beams 80, join the connecting means on the top side of the floor panel. The top ends of the beams 20 and 21 join the circumferences of the connecting means on the bottom side of the ceiling panel 7. The hollow beam 80 is hollow throughout its length and at the bottom end and at the top end this hollow space constitutes recesses for receiving projecting connecting means. The lower and top ends of the hollow beam thus form the counter-connecting means in the wall panels for joining the connecting means of the floor and ceiling panels.

Although in the foregoing connecting and counter-connecting means are described, which are formed by extensions and recesses, the connecting means may be constructed in a different way. FIG. 10 shows a different embodiment of a connecting means. This means 90, which corresponds with the directive means 50 of FIG. 6 forms a pattern by means of which a configuration can be painted on the beam 12 of a floor framework, said pattern corresponding with the opening 91 of the templet 90. The templet 90 is fastened to the jig 30 in the same manner as is indicated in FIG. 6 for the directive means 50. The templet 90 is fastened so that one side is in contact with the top side of the beam 12 in the operative position shown in FIG. 6 so that a sharply defined configuration is formed on the beam 12. The configuration formed by the opening 91 may, for example, be similar to the circumference of a beam 80 so that by this configuration the place of the beam 80 on the top side of the floor panel is determined.

FIG. 11 shows a further embodiment of a directive means. The directive means 92 of FIG. 11 comprises a sleeve 93 with an opening 94. The sleeve 93 is made of such material that a drill can be passed through the opening 94 with close fit so that through the opening 94 a hole can be drilled in the beam 12 at the desired place. In this manner a recess is made in the beam 12, which may correspond to an extension of a wall panel. As an alternative the recess made in the beam 12 through the opening 94 may correspond to a uniform or non-uniform recess in the lower side of a wall panel. Two of these recesses located opposite each other may then be utilized so that, when the panels are mounted to each other, a pin can be arranged in the recess of the floor panel, a portion of which pin not fitting in the recess made in the beam 12 through the opening 94 fits in a recess made in the lower side of the wall panel.

FIG. 12 shows a beam 95, which may be arranged in a floor panel. This beam 95 has an extension 96 pressed into the material of the beam 95. The extension 96 may have such a shape and such a position that it fits, for example, in the lower end of a beam 97, which is provided in a wall panel. The circumference of the extension, forming a directive means, may be equal to the inner circumference of the hollow lower end of the beam 97 so that the parts concerned satisfactorily join each other at the desired areas.

In order to enable a rapid relative disposition and connection of the floor, wall and ceiling panels at the mounting station, the station is provided with special means, which are shown in detail in FIGS. 4 and 13 to 21.

The mounting station comprises a supporting path having four roller paths 100, 101, 102 and 103. Each of the roller paths as is shown in FIG. 14 comprises a row of rollers 104. The roller paths 100 to 103 form a supporting path for the sections during the assembly. On the sides near the roller path 100 a stop 105 (FIG. 15) is provided and the sides of the supporting path near the roller path 103 are provided with adjustable stops 106. The stop 105 is stationary in the mounting station and extends uninterruptedly or interrupted over only small intervals throughout the length 119 of the mounting station. A stop 106 is formed by a beam having a length approximately equal to the width 107 of the building sections to be assembled on the mounting line. Each of the stop beams 106 is connected with two adjusting mechanisms 108. Near the front end of the mounting station two impact lugs 109 and 110 are arranged, which are adapted to be tilted away. The supporting path comprises conveying means 111 and 112 formed by conveyor chains extending along the roller paths 103 and 100. Each of the conveyor chains 111 and 112 is provided with catches 113 and 114 respectively. On the outer side of the supporting path, near the roller path 100, a row of supporting members 120 is arranged and on the opposite side of the supporting path there is arranged a row of supporting members 121. The supporting members 120 and 121 are rigidly secured to the floor in the mounting station so that their positions are fixed with respect to the supporting path. The supporting members 120 and 121 are spaced apart by distances 122 which correspond to the width 107 of a building section. If desired, the supporting members 120 and 121 may be arranged on the floor of the mounting station so as to be adjustable and fixable in a plurality of positions.

The supporting members 120 and 121 are identical and FIGS. 15 and 19 therefore only show a supporting member 120. The supporting member has a vertical column, the lower end of which is secured to supporting beams 124 and 125 arranged in the form of a V (FIG. 19) and secured to the floor of the mounting station. Between the supporting beams 124 and 125 and the column 123 struts 126 and 127 (FIG. 15) are arranged. On the top side of the column 123 two supporting stops 128 and 129 are fastened to the column 123 so as to be rotatable about a horizontal shaft 130. Magnetic holders 131 and 132 are adapted to turn about the shaft 130. On either side of the column 123 supporting lugs 133 and 134 are arranged for holding the magnetic retainers 131 and 132 and the stops 128 and 129 in the positions shown in FIGS. 15 and 19. Corresponding parts of the supporting members 121 are designated by the same reference numerals as those of the supporting member 120.

The assembly of a building section by means of the panels is performed as follows.

First a floor panel, for example, the floor panel 140A, is disposed on the supporting path formed by the roller paths 100 to 103. The roller paths 100 and 103 are arranged so that with the length of the sections chosen the floor panels are in contact with these roller paths by the short beams of the frameworks. The long sides 143 and 144 of the floor panel extend transversely of the direction of the roller paths 100 to 103. At the area of the roller paths 101 and 102 supporting beams 145 are arranged between the long sides 143 and 144 so that at the area of the roller paths 101 and 102 the floor panel 140 bearing on the supporting path is furthermore supported over substantially the whole width of the section. The short side of the floor panel 140A is joined to the stop 105, which is shown for the floor panel 149A in FIG. 15 for the beam 141 of the short side of the floor panel 149A. The adjustable stop 106 is urged against the beam of the other short side by means of two adjusting mechanisms 108, which is shown in FIG. 16 for the floor panel 150A with the beam 142. The adjusting mechanisms 108 near the ends of an adjustable stop beam 106 are such that they are capable of urging by hydraulic pressure against a beam corresponding with the beam 142 so that the floor panel 140A is clamped tight between the stop 105 and the pressing beam 106.

The floor panel 140 arranged at the beginning of the mounting station is brought into contact with the impact lugs 109 and 110 so that in the direction of the arrow 146 the floor panel 140A is locked in its movement with the exception of the clamping motion between the beams 105 and 106.

In this embodiment four floor panels, apart form the floor panel 140 on the supporting path, are arranged for building sections 147 to 150. These building sections and the building section 140 comprising the floor panel 140A are shown in FIG. 4 in a plan view. These floor panels are arranged so that the adjacent panels are in contact with each other. The floor panels for the sections 140 and 147 to 150 form a group of panels for the simultaneous assembly of a group of building sections. At a distance 161 from the floor panel for the section 150 a group of five floor panels for building sections 151 to 155 is arranged on the supporting path. At a distance 162 from the group of floor panels for the building sections 151 to 155 a group of five floor panels for the building sections 156 to 160 is arranged on the supporting path in the mounting station. Between the floor panels for the sections 150 and 151 spacer beams 163 and 164 are arranged which correspond to the distance 161, which is approximately equal to the width 107 of a building section. Between the floor panels of the sections 155 and 156 spacer beams 165 and 166 similar to the space 162 equal to the width of a building section are arranged cross the roller paths 100 and 103. Then the catches 113 and 114 are brought into contact with the side of the floor panel of the section 160, after which the conveying members 111 and 112 are set moving. During this movement the conveyor chains 111 and 112 are driven by hydraulic mechanisms so that the catches 113 and 114 press against the side 167 of the floor panel 160. This force is transferred via the floor panels and the spacer beams 165 and 166 and 163 and 164 respectively in the direction of succession 146 to the foremost floor panel 140, which is urged against the impact lugs 109 and 110. The conveyor chains 111 and 112 are driven so that owing to the retention of the impact lugs 109 and 110 of the three groups of floor panels the force exerted on the conveyor chains is utilized to press the floor panels of the groups tightly against one another. When the floor panels are tightly pressed against each other, they are clamped between the stop 105 on one side of the supporting path and the pressing beams 106 on the other side thereof. When the floor panels for the sections 140 and 147 to 150 are clamped tight between the stops 105 and 106, the drive of the claims 111 and 112 and hence the force exerted by the catches 113 and 114 in the direction 146 on the floor panels can be obviated.

The desired wall panels are arranged on the floor panels, the correct places of the wall panels on the floor panels being readily selected by means of the connecting means on the floor and/or wall panels. In this embodiment the wall panels can be put down on the connecting means 70 with great accuracy by the open lower ends of the vertical beams, for example, the vertical beam 80 of FIG. 17, said ends forming the counterconnecting means. The correct vertical position of the wall panels on the outer sides of the sections can be readily obtained by means of the supporting members 120 and 121, which is indicated for the wall panel 117 in FIG. 15. The wall panel 170 is comparable with the wall panels 98 of FIGS. 2 and 3. The wall panel 170 is erected and held on the stop 128, which determines the desired vertical position of the wall panel. The wall panel 170 comprises an inner board 171 arranged between the vertical beams 172 and 173 (FIG. 13). On the outer side the wall panel 170 is provided with an outer board 174. The outer board 174 extends on the bottom side of the wall panel 170 beyond the lower edge of the inner board 171 so that the lower end of the inner board 171 bears on the beam 141, whereas the lower edge of the outer board 174 extends along the outer side of the beam 141. The lower edges of the beams 172 and 173 fit by their hollow lower ends accurately around the connecting means provided at the corners of the floor panel 149A. Owing to the weight of the outer board 174 the wall panel 170 when disposed on the floor panel, tends to tilt towards the outer side, that is to say in the direction of the arrow 175. The stop 128 (FIG. 19) and the stop corresponding with the stop 129 on the other side of the wall panel 170 near the beam 173 are adjusted so that the wall panel 170 bears on the ends 176 of the stops 128, when it is accurately in a vertical position on the floor panel.

It is shown in FIG. 13 that the group of five elements 140 and 147 to 150 is chosen so that they form in common an entire dwelling in the form of a bungalow 180. In this embodiment the dwelling 180 is arranged as is shown in FIG. 13 with various inner and outer walls.

FIG. 13 shows the dwelling of five building sections at a short distance from each other so that this Figure illustrates how each of the five sections with the inner and outer walls is composed at the mounting station. If, as is shown for the building section 150 having the floor panel 150A as a bottom side, no closed outer wall is arranged on one side, this side being provided only with supporting beams 181 and 182, which may be regarded as to form an open wall panel, the magnetic retainers such as the retainers 131 and 132 are used instead of the stops such as the stops 128 and 129. For this purpose the magnetic retainer 132 is turned out of the position shown in FIG. 20 through 180° about the pivotal shaft 130 into the position shown in FIG. 16. The magnetic retainer 132 is switched on or off magnetically by means of the handle 183. After the beams 181 and 182 are arranged on the connecting means concerned of the floor panel 150A, the vertical position of the beams 181 and 182 is determined by the magnetic retainer 132 and a magnetic retainer 132 of retainers 121 near the beam 182. The handle 183 is set so that the magnetic retainers hold the metal beams 181 and 182 by magnetic force. The magnetic retainers 131 and 132 are arranged on the pivotal shaft 130 so that in the position shown in FIG. 16 for the retainer 132 they determine the vertical positions of the beams 181 and 182. The correct positions of the stops 128 and 129 and of the magnetic retainers 131 and 132 on the supporting members 120 are effectively determined also by spacer blocks 120A, which define the space between the supporting members and the roller path 100.

In order to hold wall panels such as the wall panel 190 (FIG. 13 and FIG. 14) forming outer walls in a long side of a section, use is made of adjustable supporting members, for example, the supporting member 191. These supporting members are triangular having magnetic retainers 192 and 193 on the lower side and a magnetic retainer 194 at the top side. By means of the handles 195 the magnetic retainers 192 and 193 are switched on or off. The magnetic retainer 192 fastens the supporting member to a long beam 144 of the floor panel. The magnetic retainers 193 and 194 are fastened to a vertical beam in the wall panel 190 so that the wall panel 190 can be easily held in a vertical position. The correct place of the wall panel 190 on the floor panel 140A is determined by the connecting means of the floor panel. The wall panel 190 comprises hollow beams, the lower ends of which join connecting means in the same manner as illustrated in FIGS. 17 and 18.

In order to dispose the panels forming inner walls, for example, the panel 197 in FIGS. 13 and 15 in the correct vertical position, supporting members 198 can be employed, whose lower sides are slightly shorter than the supporting member 191. The supporting member 198, like the supporting member 191, is triangular having two magnetic retainers 199 and 200 on the lower side and one magnetic retainer 201 at the top side. A beam 202 can be fixed by the magnetic retainers 201 and 200 at the edge of the inner wall panel 197, the panel then being in a vertical position. The magnetic retainers 199 and 200 can be fastened to a longitudinal beam in the floor panel 149A.

After the wall panels are arranged at the correct places on the floor panels and when the vertical positions are maintained by means of the supporting members, the wall panels can be welded at the lower ends of the metal peripheral beams to the metal beams of the floor panel. In order to fix inner wall panels the floor panel may be provided with fastening members as shown in FIG. 21. This member is formed by a length of T-profile beam embedded in the floor and adapted to have welded to it the lower end of a beam of the wall panel 210. After the wall panels have been secured to the floor panel, the roof panel can be arranged on the top sides of the wall panels. The correct place of the roof panels or ceiling panels is determined by connecting means provided on the lower sides of the metal beams of the ceiling panel. On the lower side of a ceiling panel one or more connecting means in the form of projecting members for example the connecting means 70A in FIG. 6 may be provided for the top side of each wall of the building section. The open ends of the beams in the wall panels can be joined to the connecting means 70A in the same manner as described for the lower end of the beam 80 with reference to FIGS. 17 and 18.

It will be obvious that by using the connecting means and as the case may be, of counter-connecting means and with the aid of the stationary and/or displaceable supporting members in the mounting station the wall panels can be readily erected at the correct places on the floor panels and be arranged in the correct positions relative to the floor panels. Owing to the shape of the supporting path shown comprising the roller paths 100 to 103 and to the use of the stop 105 with the clamping beams 106 the floor panels can be readily fixed in position in the mounting station. After the wall panels have been secured to the floor panels, the ceiling panels can be readily arranged in the correct manner on the wall panels and be welded thereto by means of the connecting means in the ceiling panels.

When, for example, three groups of five building sections each are assembled in the mounting station, the stops 131 and 132 and 128, 129 respectively can be turned about their pivotal shafts 130 so that they are not in contact with parts of the sections. The removable supporting members such as the supporting members 191 and 198 can be removed from the sections concerned. The clamping fit of the sections between the beam 105 and the beams 106 can then be obviated by suppressing the clamping force via the hydraulic adjusting members 108 on the beams 106, the beams 106 being then slightly displaced in a direction away from the roller path 103. Then the spacer beams 163 to 166 can be removed so that the three groups of five building sections each are standing loosely on the supporting path. The chains 111 and 112 can then be moved so that the catches 113 and 114 push the group of sections 156 to 160 along the roller paths 100 to 103 in the direction 146. Owing ot the movement of the chains 111 and 112 in the direction of the arrow 146 the catches 210 and 211 are brought into contact with the floor panel 155 so that the group of sections 151 to 155 is moved by the chains 111 and 112 in the direction of the arrow 146 out of the mounting station. The catches 212 and 213 move in the same manner the five building sections 140 and 147 to 150 in the direction of the arrow 146 out of the mounting station. The catches 200 and 201 and the catches 212 and 213 are located during the assembly of the sections at a short distance from the floor panels of the sections 135 and 150 so that the forced contact between the sections by the catches 113 and 114 is not affected.

The building sections assembled in the mounting station only have their basic shape and can be further worked, for example, on the mounting line shown in FIG. 1, to which they are moved along the supporting path when they leave the mounting station. In the mounting station a next group of building sections can then be assembled from wall panels, floor panels and ceiling panels. Although in the embodiment shown groups of adjacent building sections are assembled in the mounting station, the sections may be formed separately in the mounting station from a floor panel, wall panels and a ceiling panel. As a further alternative, groups of building sections may be assembled side by side from different number of parts than in the embodiment shown. The groups may comprise 2, 3, 4, 6, 7 or even more parts. Preferably a group of sections will be formed by sections to be joined to each other also in the building or part of the building to be erected. The simultaneous assembly of a group of sections provides a rapid and easy method of construction, whilst the connection between the sections can be satisfactorily established.

The invention is not restricted to the method and structure shown in the drawings and described in the specification, but it also relates to the constructions and methods illustrated in the drawings, which are not described.

What we claim is:

1. A method of manufacturing a box-shaped space-enlosing prefabricated building section having dimensions compatible with and size for being transported on highways by transport vehicles, the method comprising the steps of performing the functions of:

making a floor panel, a wall panel and a top panel, said floor panel and said top panel each being provided with a framework of metal beams about its periphery;

providing metal beams at opposite vertical edges of said wall panel;

accurately incorporating permanently and immovably in the framework of said floor panel and also on the framework of said top panel a pair of spaced-apart extensions proximate the corners of each;

defining and accurately incorporating on the top end of said metal beams of said wall panel a pair of recesses corresponding to said pair of extensions incorporated in said top panel and defining and accurately incorporating on the bottom end of said metal beams of said wall panel a pair of further recesses corresponding to said pair of extensions incorporated in said floor panel, said extensions and said recesses being so shaped that when received together for accurately positioning the relative positions of said panels in the assembled section each individual extension and corresponding recess combination form a set which cooperate to restrict relative movement of said panels in which they are incorporated in all horizontal directions;

casting a concrete slab within said floor panel framework, providing filling materials between said beams said wall panel;

placing said bottom pair of recesses of said wall panel on said floor panel extensions and said top panel extensions in said top edge recesses whereby said panels are accurately positioned; and rigidly fastening said panels by welding the framework of said floor panel and said top panel to said metal beams of said wall panel.

2. A method in accordance with claim 1, wherein in the step of accurately positioning said panels relative to each other, said wall panel is accurately positioned at a 90° angle ralative to said floor panel and also relative to said top panel.

3. A method of manufacturing a box-shaped, space-enclosing prefabricated building section, having dimensions compatible with and sized for being transported on highways by transport vehicles, the method comprising the steps of performing the functions of:

making elongated floor and top panels and a pair of end wall panels, said floor and top panels being formed within surrounding metal frames at the peripheries thereof and said wall panels being provided with hollow beams at their vertical edges each formed by two U-shaped metal beams;

accurately connecting to said frames of said floor panel and to said top panel rigid immovable extensions at each corner of each said frame, the extensions of said floor panel extending relatively upwardly and the extensions of said top panels extending relatively downwardly, said U-shaped beams at the bottom and top of said vertical beams of said wall panels defining recesses located and shaped snugly to receive said extensions whereby each said extension and recess combination therein independently restrict relative motion between the associated panels in all horizontal directions;

placing said wall panels whereby their said recesses receive the corresponding said extensions of said floor panel and placing said top panel whereby its said extensions are received by the corresponding said recesses of said wall panels;

accurately positioning said panels whereby said wall panels are perpendicular relative to horizontal dispositions of said floor panel and of said top panel which are placed in a superimposed parallel relationship; and rigidly and permanently connecting said wall panels to said floor panel and said top panel while so accurately positioned.

4. A method in accordance with claim 3, wherein filling materials are provided between said frame prior to connecting said panels together.

5. A method in accordance with claim 3, wherein said extensions are each formed with a generally rectangular configuration and said recesses are each formed with a corresponding rectangular configuration defined by the interior edges of said vertical beams.

* * * * *